United States Patent [19]

Glück

[11] 4,035,886

[45] July 19, 1977

[54] TENSIONING DEVICE FOR CORONA-DISCHARGE ELECTRODES

[75] Inventor: Walter Glück, Frankfurt am Main, Germany

[73] Assignee: Metallgesellschaft Aktiengesellschaft, Frankfurt am Main, Germany

[21] Appl. No.: 726,429

[22] Filed: Sept. 24, 1976

[30] Foreign Application Priority Data

Oct. 16, 1975 Germany ..... 2546305

[51] Int. Cl.[2] ..... H01J 9/06

[52] U.S. Cl. ..... 29/25.19; 140/123.5

[58] Field of Search ..... 140/123.5; 254/104; 269/234; 29/25.19

[56] References Cited

U.S. PATENT DOCUMENTS

| | | | |
|---|---|---|---|
| 2,964,294 | 12/1960 | Imonetti | 254/104 X |
| 3,738,602 | 6/1973 | Arnett | 254/104 X |

*Primary Examiner*—Richard B. Lazarus

*Attorney, Agent, or Firm*—Karl F. Ross; Herbert Dubno

[57] ABSTRACT

A device for tensioning corona-discharge electrode wires or strips in a frame for juxtaposition with collector electrodes of an electrostatic precipitator comprises a C-shaped member having a pair of pins engaging respective formations on the corona-discharge electrode and a leg opposite the pins reaching around the tube of the frame to which the end of the electrode is to be attached. The leg is formed with a guide into which a wedge is forced against the tube for the tensioning action.

5 Claims, 5 Drawing Figures

TENSIONING DEVICE FOR CORONA-DISCHARGE ELECTRODES

FIELD OF THE INVENTION

This invention relates to a device for tensioning strip-like corona-discharge electrodes which are provided with projections, are to be mounted in a frame and are adapted to be tensioned by means of wedges, see U.S. Pat. No. 3,745,620.

BACKGROUND OF THE INVENTION

That patent relates to a process for tensioning corona-discharge electrodes which are fixed in bores of frames in dustcollecting electrostatic precipitators. According to the process, each corona-discharge electrode is rod-shaped at one end, an abutment is provided at the rod-shaped end portion, a tensioning wedge is driven between the tubular frame and the abutment and used to tension the corona-discharge electrodes against the frame, and the end of the corona-discharge wire is welded to the tubular frame when the electrode has been tensioned.

To carry out that process, the rod-shaped ends of the corona-discharge electrodes are either formed with an annular peripheral groove or with a pin to provide an abutment. In an alternative mode, a removable abutment is provided at the end of a rod-shaped corona-discharge electrode or the end portion of a strip-shaped corona-discharge electrode is deformed and directly pushed through the bore in the tubular frame and tensioned by a wedge, which is driven through a slot formed in the end portion of the corona-discharge electrode.

It has been found that these modes of carrying out the prior process do not yet meet all requirements and for this reason give rise to a desire for improvement.

In the modes described first, in which an abutment formed by a groove or pin is used, a serious disadvantage resides in that the manufacture of the rod-shaped end portions is highly expensive and for this reason uneconomical. Because this part must be made in very large quantities, even small improvements can result in considerable savings.

The same remark is also applicable to the mode described last, in which the deformation of the end portion of the strip-shaped corona-discharge electrode and the forming of the slot are comparatively expensive.

The technique in which removable abutment is used has not been successful in practice because the collet chuck of the removable abutment often could not withstand the sudden load imposed as the wedge was being driven so that the corona-discharge electrodes often could not be satisfactorily tensioned.

OBJECT OF THE INVENTION

It is an object of the invention to avoid the above-mentioned disadvantages and to prove a tool which permits wedge tensioning of corona-discharge electrodes to be carried out in a much improved manner.

SUMMARY OF THE INVENTION

This object is accomplished according to the invention by the provision of a device for tensioning strip-shaped corona-discharge electrodes, which are provided with projections and are to be mounted in a frame for tensioning by means of wedges, the device comprising a substantially c-shaped tensioning member, which is provided at one end with means for engaging the corona-discharge electrode at its projections and at the other end with an abutment and a guide for a tensioning wedge.

It is apparent that the crux of this inventive concept resides in that the end portions of the strip-shaped corona-discharge electrodes are not preformed with special abutment means, nor is a collet chuck required, but a suitably designed tool is used; the tool interengages with the projections with which such corona-discharge electrodes are inherently provided and which is shaped to constitute an abutment for the tensioning wedge.

The device according to the invention engages the corona-discharge electrode within the frame and bridges the frame and the points at which the corona-discharge electrode is secured to the frame while forming outside the frame, an abutment for a wedge used to tension the corona-discharge electrode.

According to a preferred further feature of the invention, the means for engaging the corona-discharge electrode include at least two short pins, which are mutually offset. To improve the handling of the device, the tensioning member is provided with laterally disposed bearing angle members. To ensure reliable wedge action, the tensioning wedge is preferably guided in a slot. In a particularly practical arrangement, the wedge is captively held in the guide by means of a groove and a pin.

BRIEF DESCRIPTION OF THE DRAWING

Further details and advantages of the device according to the invention will be explained more fully in the following description with reference to the accompanying drawing in which.

SPECIFIC DESCRIPTION

Figure 1:
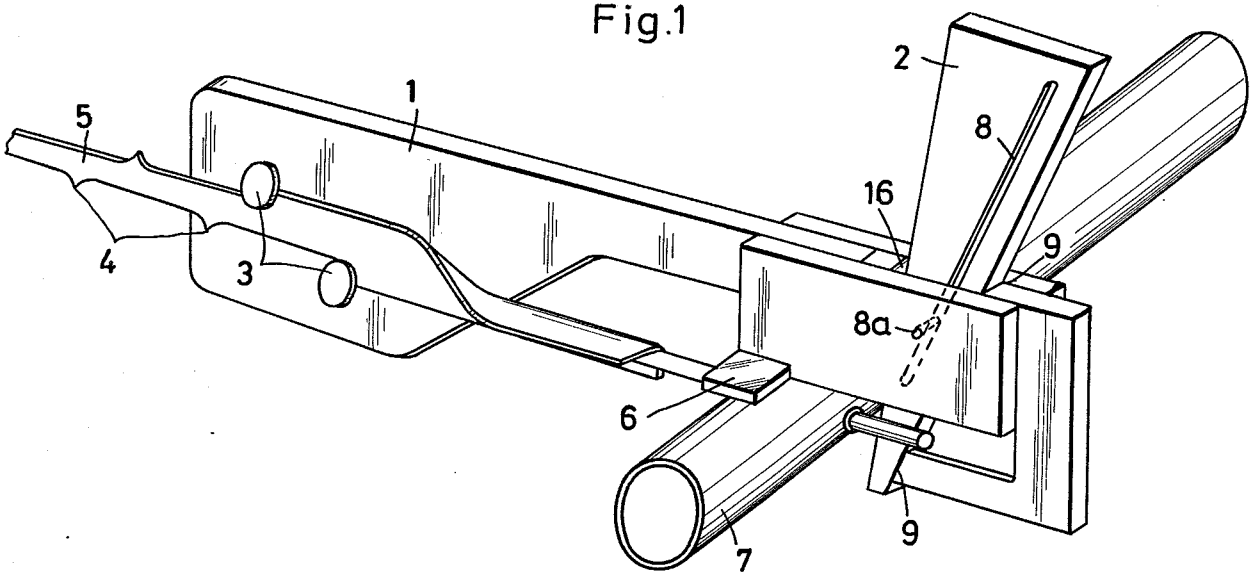
FIG. 1 is a perspective view showing the arrangement of the corona-discharge strips in a portion of the mounting frame.

The tensioning device shown in FIG. 1 comprises a tensioning member 1 and a tensioning wedge 2. Member 1 comprises a steel bar or strap laterally at one end with two pins 3 which embrace two corona-discharge spikes 4 of the corona-discharge strip 5. The tensioning member 1 is provided with two lateral-bearing angle members 6, by which the tensioning member 1 is supported in a plane perpendicular to the tube 7 of the mounting frame. This ensures that the corona-discharge spikes 4 of the corona-discharge strip 5 extend at right angles to the plane of the frame and do not turn during the tensioning operation.

The movable tensioning wedge 2 is guided in a guide 16 and is captively held in the tensioning member 1 by means of a groove 8 in a flank of the wedge and a pin **8*a* traversing the pocket formed by guide 16. During the tensioning operation, the tensioning wedge 2 engages the tube 7 of the mounting frame and the sliding surfaces 9 of the guide slot 16 formed in the tensioning member 1. A downward movement of the tensioning wedge 2 applies tension to the corona-discharge strip 5 in the longitudinal direction thereof. The pin at the end of the electrode remote from the device 1 is received in a bore of the frame and welded thereto. After tensioning, the pin proximal to the device is welded to the tube 7**.

Figure 2:
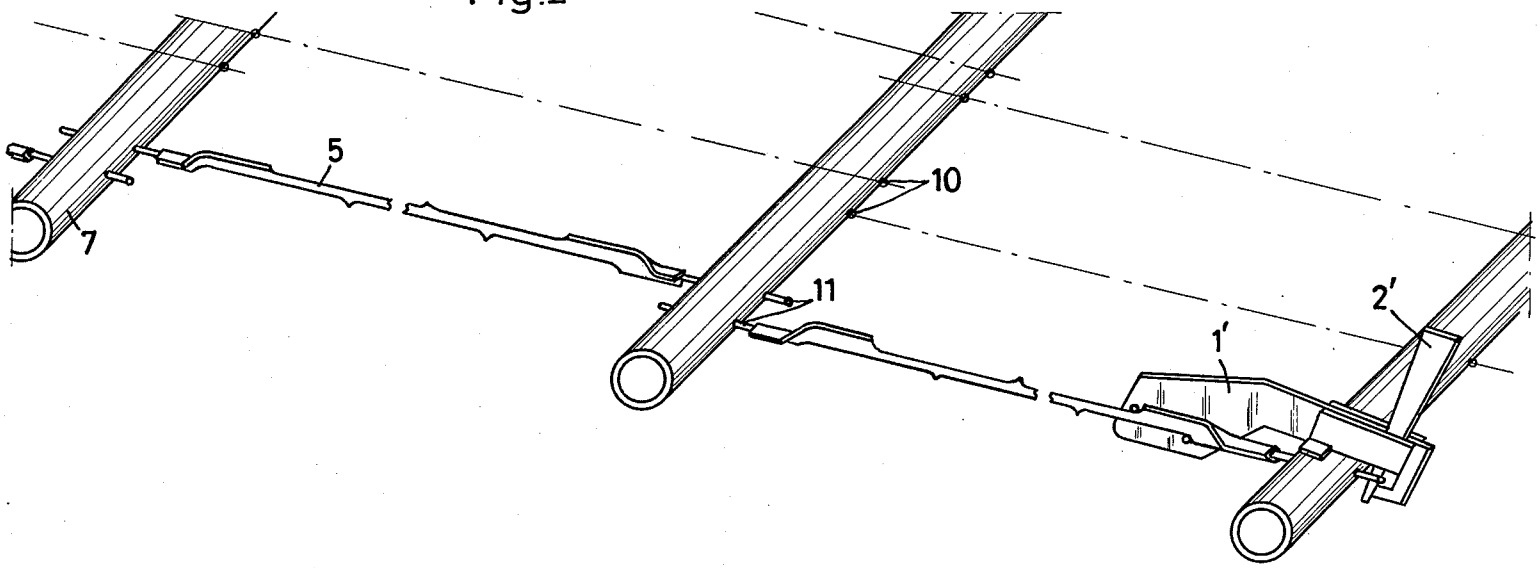

FIG. 2 shows a portion of a corona-discharge frame. This Figure shows only the horizontal tubes 7 of the mounting frame, which serve to hold the corona-discharge strips 5. The tubes 7 are provided with bores 10, which receive weldable end portions 11 which are attached to opposite ends of the corona discharge strips 5 and identically shaped. In this arrangement all weldable end portions 11 on one side of an electrode array are introduced into the bores 10 of the tube 7 and welded thereto. The opposite weldable end portions 11 of the corona-discharge strip 5 are then inserted into the bores 10 of the next tube. Each corona-discharge strip 5 is subsequently tensioned by means of the tensioning device 1', 2' according to the invention and the weldable end portion 11 on this side is then also welded to the tube.

Figure 3:
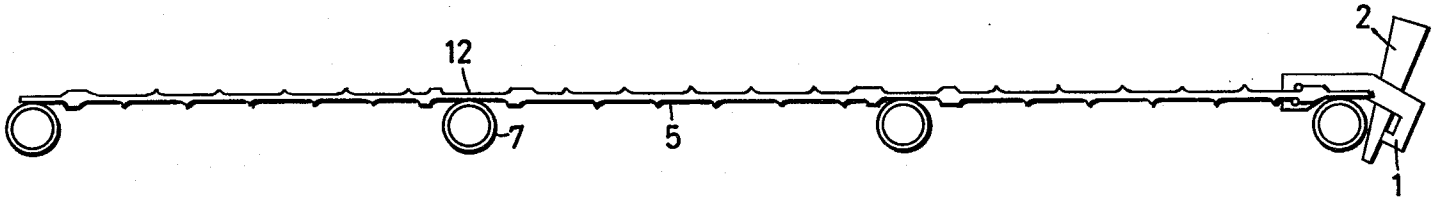
FIG. 3 is a sectional view showing a mounting frame.
Figure 4:
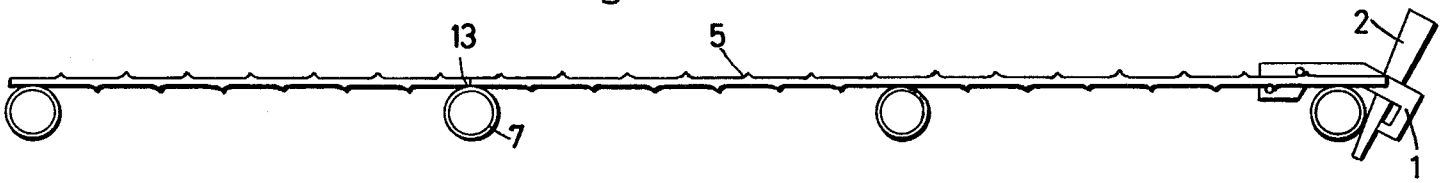
FIG. 4 is a sectional view also showing a mounting frame.

In this embodiment, special weldable end portions 11 are used, which must be welded to the corona-discharge strips 5 in a separate, preceding operation. The use of the device according to the invention permits of a further improvement, which is shown in FIGS. 3 and 4 and in which the weldable end portions 11 and the bores in the tubes 7 can be omitted. The length of the corona-discharge strip is equal to the height of the mounting frame. In FIG. 3, the corona discharge strip 5 is twisted through 90° at the weldable portions 12 so that the latter lie flat on the tube 7. In the embodiment shown in FIG. 4 the corona-discharge strip 5 need not be twisted through 90° at the weldable portions 12 because the tubes 7 are formed at these points with slots 13 for receiving about one-third of the width of the corona-discharge strip.

In the embodiment shown in FIGS. 3 and 4, the corona-discharge strips 5 are welded first to the lower tube 7 and are then tensioned throughout their length by means of tensioning device according to the invention and are subsequently welded to the intermediate tubes 7 at 12 and 13. The embodiment shown in FIG. 4 has the special advantage that the corona-discharge strip 5 may have a uniform profile throughout its length so that the strip can be wound up. In this way, the handling and storage of the corona-discharge strip can be greatly facilitated and the manufacture can be substantially improved.

Figure 5:
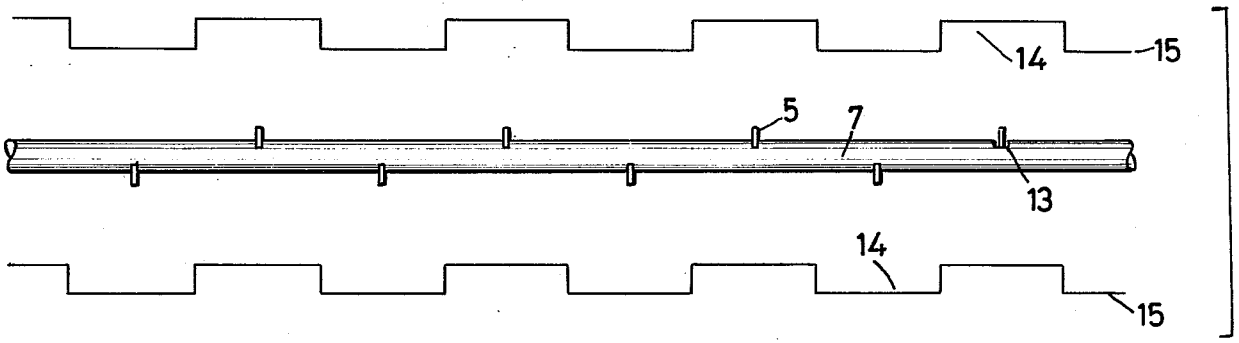
FIG. 5 is a diagrammatical horzontal sectional view showing a gas-flow passage in an electrostatic precipitator.

The offset of the corona-discharge strips shown in FIGS. 3 and 4 from the center plane of the mounting frame is not detrimental but results in considerable advantages in the overall design of dust-collecting electrostatic precipitators. When the corona-discharge wires 5 are arranged in alternation on both sides of the tube 7, as is shown in FIG. 5, the diameter of the tube can be so selected that the corona-discharge spikes 4 are so associated to the collecting electrodes 15 that the distances from all spikes 4 to the dust-collecting recesses 14 formed in the collecting electrodes 15 are the same.

As will be apparent from all of the Figures of the drawing, therefore, the device of the present invention comprises a C-shaped member receiving within the opening of the C the tube of the frame against which the corona-discharge electrode with its intrinsic staggered formations is to be tensioned. One leg of the C-shaped member has pins resting against two formations of such staggered relation, while the other leg of the C reaches around the tube and is formed with a guide at an angle to the plane of the frame and the electrode into which the wedge is driven. The C-shaped member and wedge form a tool which, once each electrode is tensioned and welded to the tube, can be removed and used for tensioning another corona electrode. The frame-engaging end of the corona electrode, the C-shaped member and wedge form together a tensioning assembly for the purposes described.

It will be understood that in the manufacture of mounting frames having corona-discharge strips 5 which are offset from the center plane of the mounting frame, the electrodes disposed on both sides of the mounting frame must be simultaneously and uniformly tensioned so that the frame will not be distorted.

Even when these special embodiments are not employed, the use of the device according to the invention results in a considerable saving of working time. The mounting frames provided with tensioned electrodes can be completed in the workshop and can be delivered in this form and be installed on the site without need for subsequent work.

I claim:

1. A tensioning assembly for a corona-discharge electrode, said assembly comprising:

an elongated corona-discharge electrode formed with staggered projections on one end and the other end fixed to a rigid tubular frame;

said frame having a side relative to which said one end is displaceable to tension said electrode;

two legs, one C-shaped member comprising a metal plate having a leg formed with a pair of mutually offset laterally projecting pins engaged behind respective projections of said one end of said electrode, and the other leg reaching around so that each leg is on opposite sides of said side of said frame, said other leg being formed with guide means inclined to the plane of said frame and said electrode, said other leg being further provided with an abutment confronting said side of said frame; and a wedge received in said guide means and bearing against said side of said frame and said abutment for drawing said staggered projections toward said side thereby tensioning said electrode between its ends.

2. The assembly defined in claim 1 wherein said C-shaped member is provided with a pair of laterally extending bearing elements between said legs and resting against said side of said frame.

3. The assembly defined in claim 2 wherein said wedge is provided with a groove and said C-shaped member is provided with a pin received in said groove and captively retaining said wedge in said guide means.

4. The assembly defined in claim 3 wherein said end overlies said side of said frame.

5. The assembly defined in claim 3 wherein said end is formed with a rod and said side of said frame is formed with a bore traversed by said rod.

* * * * *